US005694702A

United States Patent [19]

Anderson

[11] Patent Number: 5,694,702

[45] Date of Patent: Dec. 9, 1997

[54] ENHANCING CROSS-DIRECTIONAL STRETCH AND TENSILE ENERGY ABSORPTION DURING PAPER MANUFACTURE

[75] Inventor: Dennis W. Anderson, Middletown, N.Y.

[73] Assignee: International Paper Company, Purchase, N.Y.

[21] Appl. No.: 779,322

[22] Filed: Jan. 6, 1997

[51] Int. Cl.[6] ..... F26B 3/00

[52] U.S. Cl. ..... 34/446; 34/447; 34/445; 34/117; 34/120

[58] Field of Search ..... 34/114, 116, 117, 34/120, 122, 123, 446, 447, 448, 460, 461, 459, 464, 465

[56] References Cited

U.S. PATENT DOCUMENTS

| | | | |
|---|---|---|---|
| 2,144,919 | 1/1939 | Gautreau | 34/461 |
| 3,171,873 | 3/1965 | Fikentscher et al. | 34/123 |
| 4,345,385 | 8/1982 | Sando et al. | 34/446 |
| 5,377,428 | 1/1995 | Clark | 34/446 |
| 5,505,006 | 4/1996 | Wulz et al. | 34/117 |

*Primary Examiner*—Henry A. Bennett
*Assistant Examiner*—Dinnatia Doster
*Attorney, Agent, or Firm*—Barry R. Lipsitz; Ralph F. Hoppin

[57] ABSTRACT

An unrestrained drying capability is added to an existing series of rotating drying cylinders in a cost- and space-efficient manner to enhance cross-directional (CD) stretch and tensile energy absorption (TEA) in a paper web such as for sack kraft grade paper. High-intensity air glide drying devices are adapted for use in a variety of configurations to provide different levels of unrestrained drying capacity for a pre-existing series of rotating drying rollers. The air glide drying devices carry the paper web on a cushion of air which is heated preferably to 500°–850° F. The sheet moisture content of the paper web during heating in the unrestrained drying section decreases by at least approximately 5%, with an evaporation rate of approximately 15–30 lbm/hr/ft$^2$. A preferred temperature range of the paper web upon entry to the air glide drying device is 160°–210° F. A pre-heater such as a convection or infrared heater may optionally be employed. A variety of configurations are disclosed to allow a gradual increase in the unrestrained drying capability without requiring extensive retrofitting of existing equipment.

20 Claims, 5 Drawing Sheets

ENHANCING CROSS-DIRECTIONAL STRETCH AND TENSILE ENERGY ABSORPTION DURING PAPER MANUFACTURE

BACKGROUND OF THE INVENTION

The present invention relates to an apparatus and method for enhancing cross-directional (CD) stretch and tensile energy absorption (TEA) during paper manufacture, and is particularly suited for use with sack kraft grade paper.

Kraft paper is a high strength paper which is produced using bleached or unbleached sulfate pulp. The paper has a grammage typically of 60–150 g/m$^2$. The strength of a kraft paper sack in a real world application such as in carrying cement or the like is related to the TEA of the paper. The TEA is the total amount of work per unit area which will cause the paper to rupture. Furthermore, the TEA is related to the breaking load and the stretch at break. Moreover, a kraft paper sack should have an adequate TEA in the cross direction where the greatest stresses are found in many end uses.

Various techniques are used to enhance CD stretch and TEA in sack kraft grade paper, including creping or micro-creping, use of high consistency refined pulp, and use of unrestrained drying. Creping or micro-creping equipment adds expense and complexity to a paper manufacturing process, and increases stretch primarily in the machine direction but not in the cross direction. Moreover, creping gives the paper a wrinkled appearance which may not be desired. Furthermore, the use of high consistency refined pulp also increases expenses, but may not, by itself, improve CD stretch and TEA sufficiently.

Unrestrained drying, also known as free drying or floatation drying, allows a paper web (e.g., sheet) to shrink freely, with minimal or no CD restraint, during drying. This has been achieved in practice with single or multi-pass straight-through convection heaters such as those manufactured by ABB Flakt. Such heaters dry the paper web with air temperatures of 300°–500° F. but are very large and therefore not easily adapted for use with existing series cylinder dryer systems. Moreover, such a device cannot easily be bypassed when unrestrained drying is not required, and does not allow incremental changes in unrestrained drying capability.

Thus, existing approaches have not been satisfactory in providing a space efficient and flexible unrestrained drying capacity. Moreover, it has been difficult and expensive to retrofit existing paper web processing systems to provide an unrestrained drying capability. Installation of unrestrained drying on a paper machine generally requires the removal of existing drying equipment and extensive downtime for the facility. Additionally, since unrestrained drying equipment is sized for the specific machine it is intended to be used with based on required production rates, location on the machine, and drying loads, including initial and final paper moisture, among other factors, overdesign is a common problem. That is, a manufacturer will commonly size the drying equipment in consideration of potential future production increases since it has not been feasible to gradually add additional unrestrained drying capacity when required.

Furthermore, existing systems have limited flexibility in modifying the drying curve (e.g., web moisture vs. degree of web restraint) and the resultant paper properties. Generally, the unrestrained drying system must be used fully or not at all. Potential installation configurations will also be limited by the grade structure of the manufacturing facility and the desired end results.

Accordingly, it would be desirable to provide an apparatus and method for improving CD stretch and TEA in a paper web which solves the above and other problems. The system should provide an unrestrained drying capability for use with a series of conventional drying cylinders without requiring substantial modification or retrofitting of the drying cylinders. The system should allow varying levels of unrestrained drying capability, and a bypass mechanism should be provided to allow bypassing of some or all of the unrestrained drying equipment. The present invention provides a system having the above and other advantages.

SUMMARY OF THE INVENTION

In accordance with the present invention, an apparatus and method are presented for providing an unrestrained drying capability for use with a series of conventional rotating drying cylinders to enhance cross-directional (CD) stretch and tensile energy absorption (TEA) in a paper web such as for sack kraft grade paper.

An apparatus which provides unrestrained drying of a paper web to enhance CD stretch and TEA includes a high-intensity air glide drying device. The device may be an air turn device with a convex surface, an air glide cylinder, or a planar air glide surface which has one or two faces. The device has at least a first face for circulating hot gas at a first surface of the paper web as the paper web is transported through the air glide drying device. Generally, the hot gases are in a temperature range of approximately 400°–1,000° F., or preferably, in a temperature range of approximately 500°–850° F. A velocity of the hot gases is approximately 10,000 to 20,000 feet per minute, or preferably, 13,000 to 18,000 feet per minute. An evaporation or loss rate is approximately 15–30 pounds per hour per square foot (lbm/hr/ft$^2$).

One or more air glide drying devices may be arranged to provide drying of the paper web such that the sheet moisture content of the paper web is reduced from a range of approximately 40–75% to a range of approximately 10–20%. Generally, a 5% or greater reduction in sheet moisture content during unrestrained drying is beneficial, so each air glide drying device should provide at least approximately a 5% reduction in sheet moisture content. Alternatively, it is possible for one air glide device to provide the entire sheet moisture content reduction. The device may be used, in particular, for uncoated sack kraft grade paper.

The air glide drying device may have a second face which opposes the first face for circulating hot gas at the other surface of the paper web as the paper web is transported through the air glide drying device. Preferably, the paper web is provided at a temperature range of approximately 160°–210° F. just prior to transport through the air glide drying device. A pre-heater such as a convection or infrared heater may be employed if necessary for sensible heat addition to the paper web for this purpose (e.g., where the added heat produces a temperature increase in the paper web). Alternately, such a heater may be used independently to provide additional drying capacity.

Furthermore, an apparatus is presented for adding an unrestrained drying capability to an assembly of rotating drying cylinders including first and second series of drying cylinders which transport a paper web therethrough. The first and second series of drying cylinders are disposed at a substantially common elevation, and may be arranged in top and bottom tiers in a staggered manner, or, alternatively, in a single-tiered configuration. A high-intensity air glide drying device receives the paper web from the first series of drying cylinders, and expels hot gases toward the paper web at a temperature and velocity for drying the paper web to improve CD stretch and TEA therein. The air glide drying device may be disposed at a second elevation which is beyond the first and second series of drying cylinders. For example, the air glide drying device may be situated in a basement below the assembly of cylinders which are located on an operating floor of a manufacturing facility.

To provide a bypass capability, a diverting device may be disposed between the first and second series of drying cylinders for directing the paper web to the air slide drying device in a first mode and to the second series of drying cylinders in a second mode. The diverting device may be associated with an extensible unit. Generally, transport of the paper web through the apparatus will be unidirectional, e.g., with no reversing transport.

In a specific embodiment, the first and second series of drying cylinders are arranged in corresponding staggered top and bottom tiers. Alternatively, a single tier configuration may be used. Means are provided for diverting the paper web from a last cylinder of the first series of cylinders to the air glide drying device, and from the air glide drying device to a first cylinder of the second series of cylinders such that incorporation of the air glide drying device into the series of drying cylinders requires a space between the first and second series of drying cylinders which is no greater than a space occupied by three of the drying cylinders, one from one of the tiers and two from the other of the tiers. That is, removal of up to three cylinders in a pre-existing series of drying cylinders may be required to install the air glide drying device. In another embodiment, no cylinders need be removed. Thus, retrofit costs, space requirements and total drying capacity are optimized.

Moreover, additional air glide drying devices may be arranged with some at the second elevation and some at a third elevation such that the paper web is transported in a cascaded or zigzag manner. For example, the second elevation may be below the drying cylinders, while the third elevation is above the drying cylinders.

Additionally, a method is presented for adding an unrestrained drying capability to an assembly of rotating drying cylinders including first and second series of drying cylinders which transport a paper web therethrough. The method includes the steps of diverting the paper web from the first series of cylinders, circulating hot gas at the paper web at a temperature and velocity for drying the paper web to improve CD stretch and TEA therein, and then providing the paper web to the second series of drying cylinders for transport therethrough.

DETAILED DESCRIPTION OF THE INVENTION

An apparatus and method are presented for providing an unrestrained drying capability for use with a series of conventional rotating drying cylinders to enhance cross-directional (CD) stretch and tensile energy absorption (TEA) in a paper web such as for sack kraft grade paper.

Figure 1:
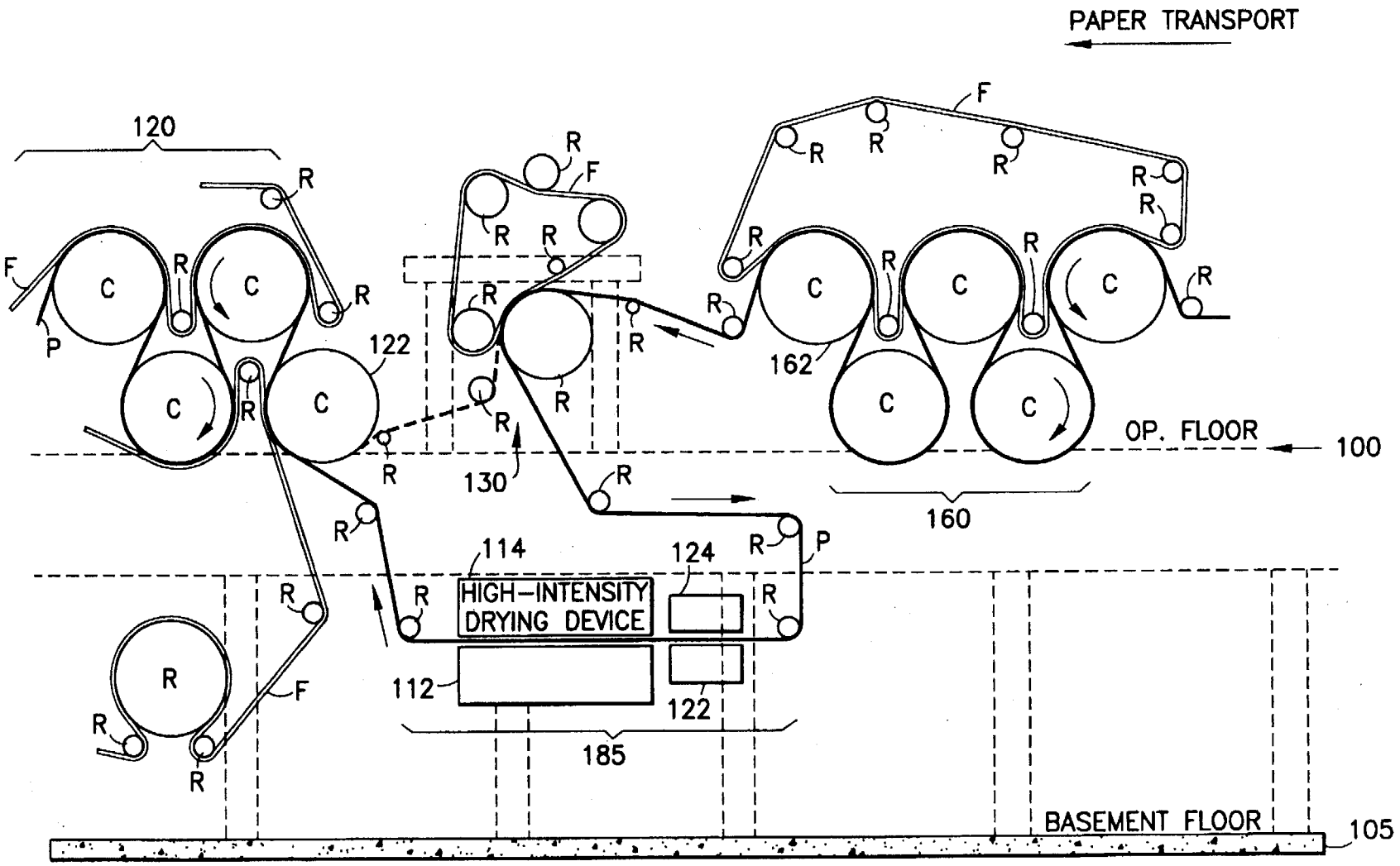
FIG. 1 is a block diagram of a high intensity unrestrained drying device and an extensible unit for use with a series of conventional drying cylinders in accordance with the present invention, where no conventional drying cylinders are removed.

FIG. 1 is a block diagram of a high intensity unrestrained drying device and an extensible unit for use with a series of conventional drying cylinders in accordance with the present invention, where no conventional drying cylinders are removed. In the configuration shown, a paper web P, indicated by a heavy line, is transported from right to left through the drying equipment, including first and second series of conventional drying cylinders 160 and 120, respectively. The first series of drying cylinders 160 includes a drying cylinder 162. Each drying cylinder, labeled "C", is approximately five to six feet in diameter, and may be steam-heated. A dryer felt F, indicated by a double line, is optionally used to restrain the paper web against the hot drying cylinders, and is carried using guide rollers R as shown to provide the proper tension and support. Dryer felt may also be used in the remainder of the figures disclosed herein but is not shown.

A high-intensity air glide drying device 112, 114 is shown situated in an unrestrained drying section 185 which is near a basement floor 105, and below an operating floor 100 of a manufacturing facility. A diverting device diverts the paper web from the extensible unit to the air glide drying device 112, 114, or to the second series of cylinders 120. The diverting device may include one or more rollers R as shown.

When the diverting device is in a first, diverting mode, the paper web is transported to an elevation which is beyond (e.g., above or below) that of the drying cylinders to the air glide drying device 112, 114. A pre-heater 122, 124, which may be a convection or infrared heater, for instance, may optionally be used to heat the paper web to 160°–210° F. The air glide drying device 112, 114 is shown with a first section 112 which circulates hot gases at the bottom side of the paper web while a second section 114 circulates gases at the top side of the paper web. The gases carry moisture away from the paper web. Note that each section 112, 114 typically will also include intakes for recirculating or exhausting the moist gases. The supply air may be heated, for example, to a temperature range of 400°–1,000° F., or more preferably, to a range of 500°–850° F. The velocity of the hot gases is approximately 10,000 to 20,000 feet per minute (ft/min), or more preferably, 13,000–18,000 ft/min. An evaporation or loss rate of the paper web as it is transported through the drying device 112, 114 is approximately 15–30 pounds per hour per square foot (lbm/hr/ft$^2$). The sheet moisture content of the paper web during drying by the air glide drying device should decrease by at least approximately 5%, and the overall decrease in sheet moisture content preferably is from the range of approximately 40–75% to the range of approximately 10–20%. For example, a decrease from about 50% to 15% may be used.

With the configuration of FIG. 1, for example, the first series of drying cylinders 160 may reduce the sheet moisture content of the paper web from 50% to 40%, the air glide drying device 112, 114 may reduce the sheet moisture content from 40% to 25%, and the second series of drying cylinders 120 may reduce the sheet moisture content from 25% to 15%. Thus, the overall decrease in sheet moisture content is from 50% to 15%.

In an alternative embodiment, not specifically shown, additional air glide drying devices and series of drying cylinders may be used. For example, a first series of drying cylinders may reduce the sheet moisture content from 70% to 60%, a first air glide drying device may reduce the sheet moisture content from 60% to 50%, a second series of drying cylinders may reduce the sheet moisture content from 50% to 40%, a second air glide drying device may reduce the sheet moisture content from 40% to 30%, a third series of drying cylinders may reduce the sheet moisture content from 30% to 20%, and a third air glide drying device may reduce the sheet moisture content from 20% to 15%. Thus, the overall decrease in sheet moisture content is from 70% to 15%.

The drying device 112, 114 is shown as a straight-through apparatus with substantially planar faces which produce the air cushion for heating and/or drying of the paper web. However, the heating and/or drying may be provided on only one side of the paper web, and the drying device 112, 114 may alternatively include curved and/or straight regions for heating, drying and/or turning the paper web. After being processed at the drying device 112, 114, the paper web is transported to a first cylinder 122 of the second series of cylinders 120 for transport therethrough.

Note that the configuration shown may be modified in various ways. For instance, the drying device 112, 114 may be located above the cylinders C instead of below. Moreover, a plurality of the drying devices may be used by providing the appropriate paper web transport path. Other modifications and variations will become apparent in view of the following figures. Generally, the number of guide rollers needed depends on the length of the unsupported sheet run, web grammage, web speed, and the direction of sheet travel.

When the diverting device is in a second mode, the air glide drying device 112, 114 is bypassed, and the paper web is transported directly from the extensible device 130 to the cylinder 122 as indicated by the heavy dashed line. Bypass may be desired, for example, when different types of paper are being processed which do not require unrestrained drying. Thus, the configuration is highly flexible.

Figure 2:
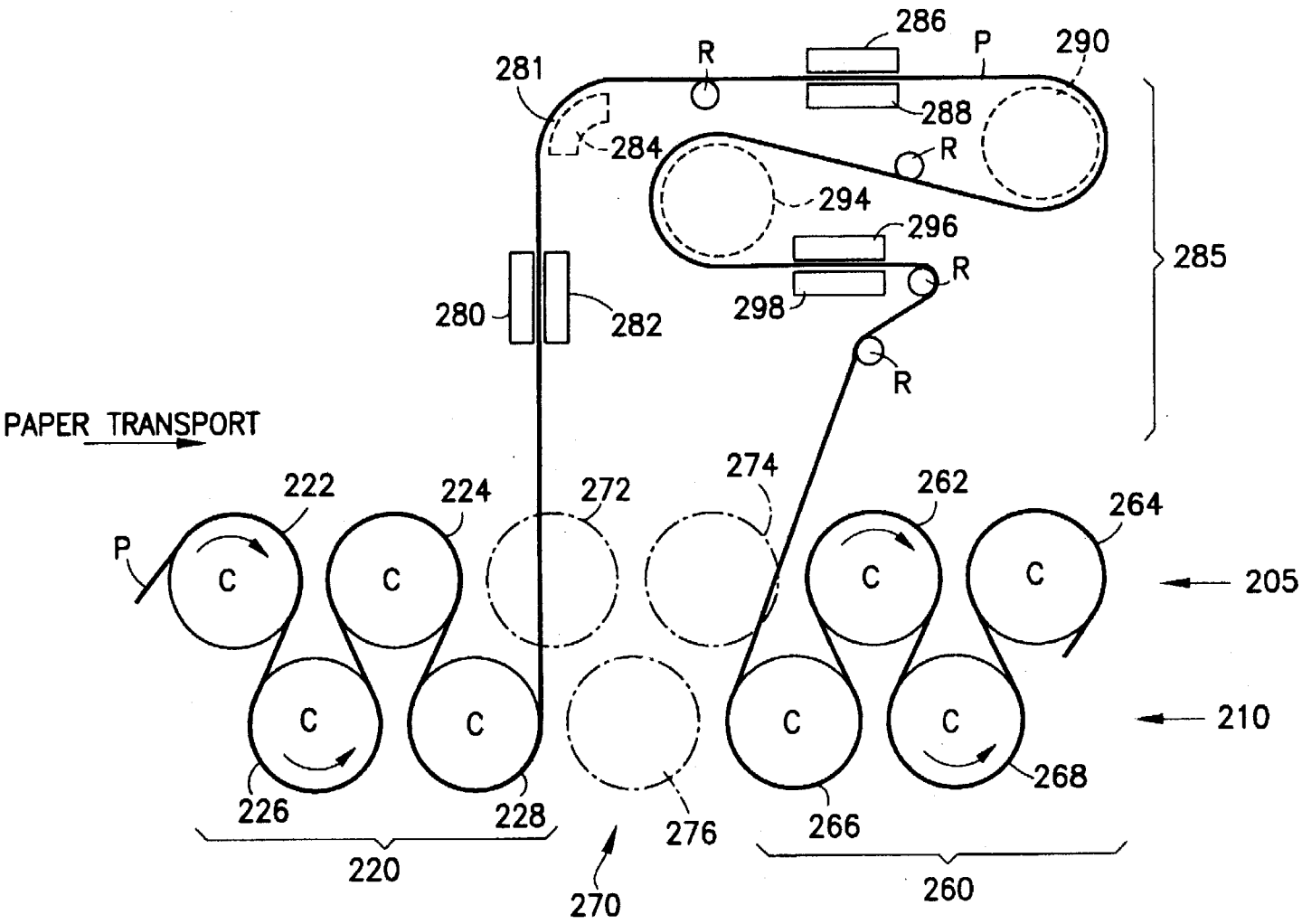
FIG. 2 is a block diagram of high intensity unrestrained drying devices for use with a series of drying cylinders in accordance with the present invention, where three conventional drying cylinders are removed.

FIG. 2 is a block diagram of high intensity unrestrained drying devices for use with a series of conventional drying cylinders in accordance with the present invention, where three drying cylinders are removed. Paper transport is from left to right. A first series of conventional rotating drying cylinders, shown generally at 220, includes cylinders 222, 224, 226 and 228. A second series of such cylinders, shown generally at 260, includes cylinders 262, 264, 266 and 268. The cylinders C of the first and second series are arranged in a top tier 205 and a bottom tier 210 in a staggered manner. Moreover, generally the rotating cylinders will be of equal diameter, equi-spaced in the horizontal direction, and disposed at a common elevation.

A space, shown generally at 270, represents an area where three cylinders 272, 274, 276 would be located in a conventional drying cylinder assembly that does not have an unrestrained drying capability. In accordance with one embodiment of the present invention, an unrestrained drying capability is incorporated into the assembly in the space 270 which is no greater than a space occupied by three drying cylinders 272, 274 and 276. This provides significant space savings compared to a conventional unrestrained drying oven, which may be over one hundred feet in length. With a drying cylinder diameter of approximately five feet and a inter-cylinder spacing of approximately fifteen inches, the space 270 will be roughly seven and one-half to thirteen feet measured horizontally.

In accordance with the present invention, the paper web is transported through the first series of cylinders 220, and from the last cylinder 228 to the unrestrained drying section, shown generally at 285. In the embodiment shown, the paper web first passes through an auxiliary heater which includes elements 280 and 282. The auxiliary heater may be a pre-heater if it is located near the air glide drying device and there is a need for pre-heating of the paper web, or the auxiliary heater may provide additional independent unrestrained drying of the paper web. The paper web is then transported over a cushion of air 281 produced by an air glide element 284. The particular air glide element shown is an air turn element since it changes the travel direction of the paper web (e.g., by 90° in FIG. 2) by carrying the paper web on a high-temperature air cushion.

After being heated and turned by the air glide element 284, the paper web is transported through another auxiliary heater 286, 288 and to another air glide element 290. Element 290 is an air glide cylinder which can expel high-temperature gases in an arc of 180° or greater. Non-rotating air glide cylinders, such as the "Jet Foil" model, manufactured by Spooner Industries, Ltd., have been used for non-contact drying of a paper web after surface treatment by a coater or size press, may be adapted for use herein. Generally, a coater coats the paper web, for instance, with a latex product to improve the aesthetic appearance and printability of the web. A size press typically adds a water based solution to the paper web to add strength and stiffness, e.g., by starching the paper web.

Alternatively, the air glide cylinder 290 may be modified to expel gases only in the region where the paper web is directly carried by blocking the appropriate outlets, or a baffle or the like may be used to redirect the gases toward the paper web. The element 290 further heats the paper web and turns it by an angle of roughly 180° in FIG. 2. The paper web is carried by another air glide cylinder 294 and again turned through an angle of roughly 180°. The paper web then passes through another auxiliary heater 296, 298 and finally to a first cylinder 266 of the second series of cylinders 260 for transport therethrough. It will be understood that the configuration and corresponding turning angles are examples only.

The drying cylinders C are typically steam heated to provide the majority of drying of the paper web. Note that, in a feedback control system, it is possible to provide detection equipment for measuring the air temperature and velocity of the circulated gases, and the web moisture content and other parameters of the paper web as it is transported through the unrestrained drying section 285. The auxiliary heating and air glide elements may be adjusted, or turned on and off accordingly to achieve the desired drying profile. Generally, pre-heaters are used when the paper web is transported over a distance where significant cooling may occur and it is desired to pre-heat the paper web to improve the drying efficiency of the air glide drying device. Moreover, note that various guide rollers R are used to support, guide and tension the paper web as required.

Figure 3:
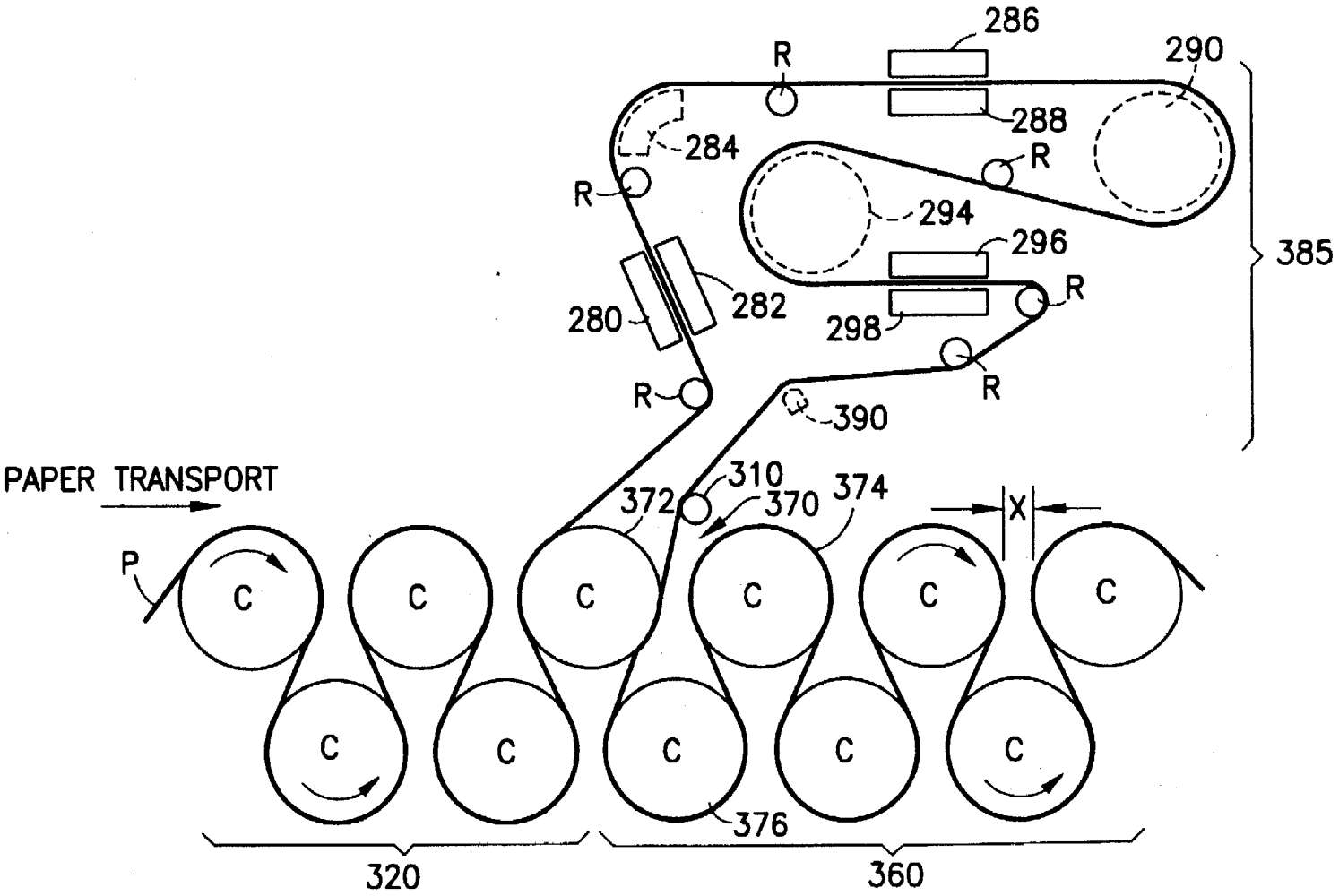
FIG. 3 is a block diagram of high intensity unrestrained drying devices for use with a series of conventional drying cylinders in accordance with the present invention, where no conventional drying cylinders are removed.

FIG. 3 is a block diagram of high intensity unrestrained drying devices for use with a series of conventional drying cylinders in accordance with the present invention, where no drying cylinders are removed. Like numbered elements correspond to the elements of FIG. 2. Here, the first series of cylinders includes a last cylinder 372 which transports the paper web P to the unrestrained drying section shown generally at 385. The paper web is turned and dried as discussed previously, then returned to a first cylinder 376 of the second series of cylinders 360. Roller 310 is positioned to transport the paper web under cylinder 372 to cylinder 376. The space 370 is equal to a fixed distance x (e.g., fifteen inches) which separates the drying cylinders in either tier when the cylinders are equi-spaced. Alternatively, when the drying cylinders are arranged in independently-driven groups, for example, with two to twenty cylinders, the space 370 may be somewhat larger than that indicated in FIG. 3. This would provide additional flexibility in locating the roller 310 and in routing the paper web.

An air glide drying device 390 is an air turn device for turning the paper web and providing further drying before the paper web is returned to the cylinder 376. Optionally, a roller may be used in its place to properly guide the paper web.

The configuration shown thus advantageously provides additional drying capacity with a higher CD shrinkage potential of the paper at an increased production rate on dryer-limited paper machines. Furthermore, the downtime required for installation is less than conventional approaches since little or no demolition of existing equipment is required, and a substantial amount of construction can be accomplished during normal maintenance outages. Moreover, moisture in the paper web is controlled with the optional convection or infrared heaters 280, 282, 286, 288, 296, 298.

Figure 4:
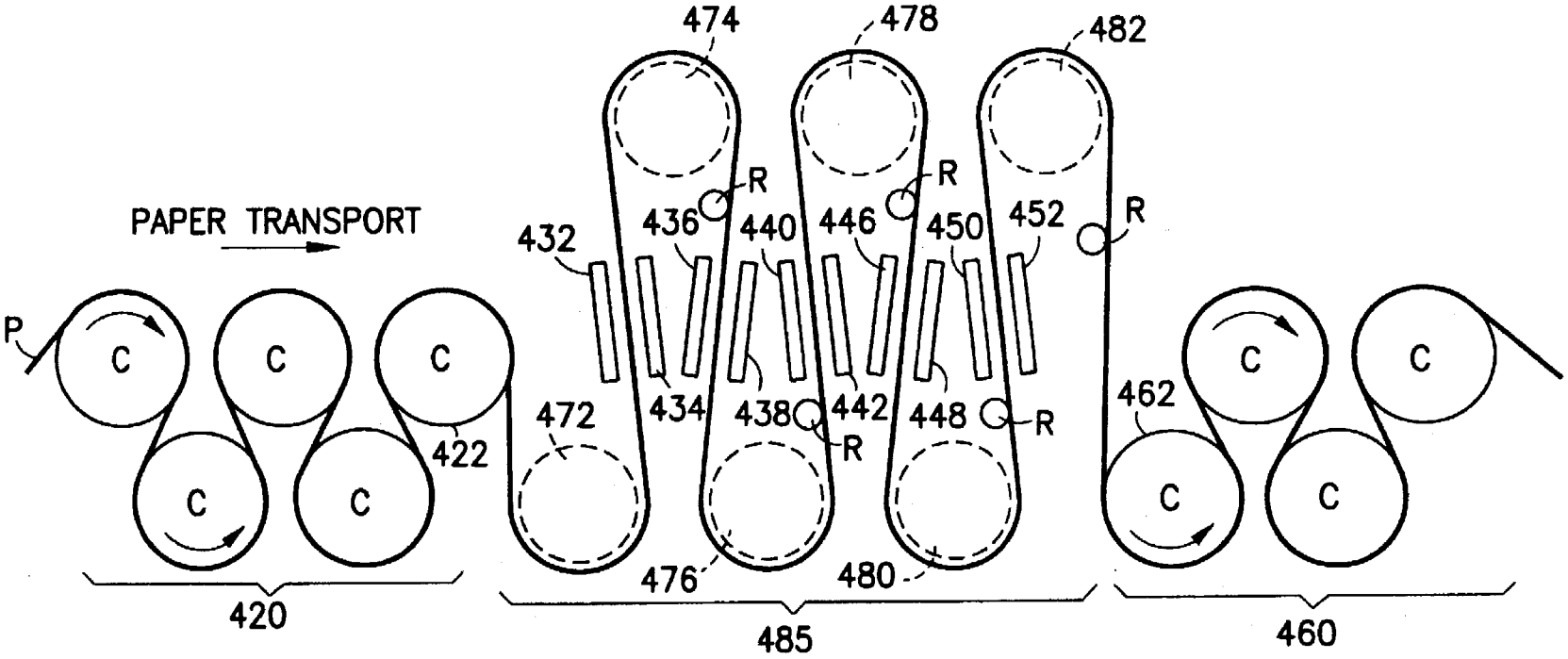
FIG. 4 is a block diagram of high intensity unrestrained drying devices in a cascaded configuration for use with a series of conventional drying cylinders in accordance with the present invention.

FIG. 4 is a block diagram of high intensity unrestrained drying devices in a cascaded configuration for use with a series of conventional drying cylinders in accordance with the present invention. The paper web is carried over a first series of drying cylinders 420, and from a last cylinder 422 to the unrestrained drying section shown generally at 485. Specifically, the paper web is transported from the last cylinder 422 to air glide drying devices 472, 474, 476, 478, 480 and 482 which are air glide cylinders arranged to carry the paper web in a cascaded or zigzag manner. The paper web is transported from air glide drying device 482 to a first cylinder 462 of a second series of drying cylinders 460. Optionally, auxiliary heaters 432–452 are provided which heat either one or both sides of the paper web, thereby promoting additional drying. Rollers R are provided as shown to guide and support the paper web. Advantageously, the very long sheet run with this configuration further promotes CD shrinkage.

Additional drying capacity can be provided as needed to the unrestrained drying section 485. Moreover, different portions of the unrestrained drying section 485 can be utilized for different paper grades. For example, a heavier paper or a multi-layer paper may require use of all elements in the drying section 485, while a lighter paper may require use of only some of the elements. Thus, the configuration may be easily adapted to meet different paper drying requirements.

Figure 5:
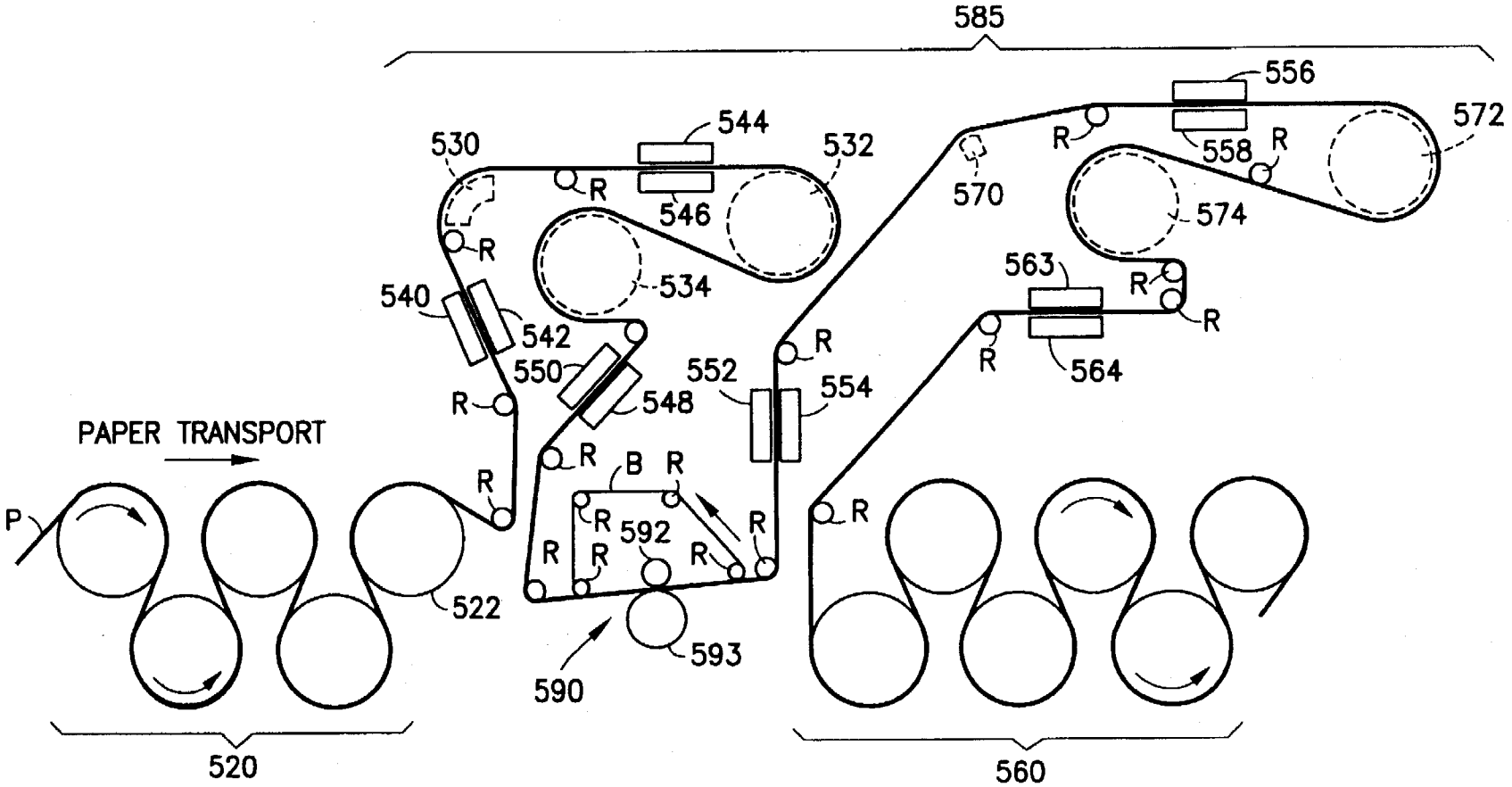
FIG. 5 is a block diagram of high intensity unrestrained drying devices and an extensible unit for use with a series of conventional drying cylinders in accordance with the present invention.

FIG. 5 is a block diagram of high intensity unrestrained drying devices and an extensible unit for use with a series of conventional drying cylinders in accordance with the present invention. In the embodiment shown, a large amount of unrestrained drying capability is provided by six air glide drying devices 530, 532, 534, 570, 572 and 574, which are part of the unrestrained drying section shown generally at 585. The paper web is transported through a first series of drying cylinders 520, and from a last cylinder 522 to air glide drying devices 530, 532 and 534. Device 530 is an air glide turning device, while devices 532 and 534 are air glide cylinders. Pre-heaters or auxiliary heaters 540–550 are optionally provided. After exiting the auxiliary heater 548, 550, the paper web is transported to an optional extensible unit, shown generally at 590. For example, the extensible unit 590 may comprise a machine direction (MD) micro-creping unit which includes a belt B which crepes the paper web using creping cylinders 592, 593.

The paper web is then transported to air glide drying devices 570, 572 and 574 for additional unrestrained drying. Device 570 is an air glide turning device, and devices 572 and 574 are air glide cylinders. Pre-heaters or auxiliary heaters 552, 554, 556, 558, 563 and 564 are optionally provided to further increase the available drying capacity. The paper web is finally routed to a first cylinder 562 of the second series of drying cylinders 560. Rollers R are used as shown to guide and support the paper web.

As can be seen, the present invention provides great flexibility in using high-intensity air glide drying devices to provide an unrestrained drying capability for use with a series of conventional rotating drying cylinders. By increasing the flexibility of the drying system, additional capacity can be added as needed, and unrestrained drying can be located in more than one location in the machine direction. For example, the high-intensity air glide drying devices may be provided in more than one machine direction location, and can be used both before and/or after such process equipment as a breaker stack, an extensible unit which provides creping, size press, coater or other unit process on the machine.

Although the invention has been described in connection with various specific embodiments, those skilled in the art will appreciate that numerous adaptations and modifications may be made thereto without departing from the spirit and scope of the invention as set forth in the claims. For example, while the invention has been discussed for use in conjunction with a paper web such as sack kraft grade paper, webs of other types of material may be used, including single or multi-layered webs.

What is claimed is:

1. An apparatus for providing unrestrained drying of a paper web to enhance cross-directional stretch and tensile energy absorption, comprising:

a high-intensity air glide drying device comprising at least a first face for circulating hot gases at a first surface of said paper web as said paper web is transported through said air glide drying device; wherein:

said hot gases are in a temperature range of approximately 400° to 1,000° F.;

said hot gases are circulated at a velocity of approximately 10,000 to 20,000 feet per minute; and an evaporation rate of said paper web is approximately 15 to 30 pounds per hour per square foot (lbm/hr/ft$^2$) of said paper web.

2. The apparatus of claim 1, wherein:

said hot gases are in a temperature range of approximately 500°–850° F.

3. The apparatus of claim 1, wherein:

said high-intensity air glide drying device reduces a sheet moisture content of said paper web by at least approximately 5%.

4. The apparatus of claim 1, wherein:

said paper web comprises uncoated sack kraft grade paper.

5. The apparatus of claim 1 wherein:

a sheet moisture content of said paper web is reduced from approximately 40–75% to approximately 10–20%.

6. The apparatus of claim 1, wherein said high-intensity air glide drying device further comprises:

a second face opposing said first face for circulating hot gases at a second surface of said paper web as said paper web is transported through said air glide drying device.

7. The apparatus of claim 1 wherein:

said paper web is provided at a temperature range of approximately 160°–210° F. immediately prior to said transport through said air glide drying device.

8. An apparatus for adding an unrestrained drying capability to a series of rotating drying cylinders including first and second series of drying cylinders which transport a paper web therethrough, said first and second series of drying cylinders being disposed at a substantially common elevation, comprising:

a first high-intensity air glide drying device for receiving said paper web from said first series of drying cylinders;

said device comprising at least a first face for circulating hot gas in a temperature range of approximately 400° to 1,000° F., and at a velocity of approximately 10,000 to 20,000 feet per minute, at a first surface of said paper web as said paper web is transported through said air glide drying device; wherein:

said hot gases dry said paper web at an evaporation rate of approximately 15 to 30 pounds per hour per square foot (lbm/hr/ft$^2$) of said paper web to improve cross-directional stretch and tensile energy absorption therein;

said device is disposed at a second elevation which is beyond said first and second series of drying cylinders;

said device provides said paper web to said second series of drying cylinders after processing said paper web; and a sheet moisture content of said paper web is reduced from approximately 40–75% to approximately 10–20%.

9. The apparatus of claim 8, further comprising:

a diverting device disposed between said first and second series of drying cylinders;

said diverting device being able to direct said paper web to said air glide drying device in a first mode and to said second series of drying cylinders in a second mode.

10. The apparatus of claim 8 wherein:

transport of said paper web through said apparatus is unidirectional.

11. The apparatus of claim 8, further comprising:

a pre-heater disposed proximate to said air glide drying device for providing said paper web at a temperature range of approximately 160°–210° F. immediately prior to said transport through said air glide drying device.

12. The apparatus of claim 8, wherein:

said first and second series of drying cylinders are arranged in corresponding staggered top and bottom tiers; and means are provided for diverting said paper web from a last cylinder of said first series of cylinders to said air glide drying device, and from said air glide drying device to a first cylinder of said second series of cylinders such that incorporation of said air glide drying device into said series of drying cylinders requires a space between said first and second series of drying cylinders which is no greater than a space occupied by three of said drying cylinders, one from one of said tiers and two from the other of said tiers.

13. The apparatus of claim 8, wherein:

said first and second series of drying cylinders are arranged in corresponding staggered top and bottom tiers and are substantially equi-spaced within each tier by a fixed distance; and means are provided for diverting said paper web from a last cylinder of said first series of cylinders to said air glide drying device, and from said air glide drying device to a first cylinder of said second series of cylinders such that incorporation of said air glide drying device into said series of drying cylinders requires a space between said first and second series of drying cylinders which is no greater than a space occupied by said fixed distance.

14. The apparatus of claim 8, wherein:

a second air glide drying device is provided at a third elevation which is beyond said series of drying cylinders and which is different than said second elevation; and said paper web is transported from a last cylinder of said first series of cylinders to said first air glide drying device, subsequently to said second air glide drying device, and subsequently to a first cylinder of said second series of cylinders.

15. The apparatus of claim 8, wherein:

a plurality of additional air glide drying devices are provided, said additional devices being arranged alternately at a third elevation which is beyond said series of drying cylinders and which is different than said second elevation, and at said second elevation in a cascaded manner; and said paper web is transported from a last cylinder of said first series of cylinders to said first air glide drying device, subsequently to said additional air glide drying devices, and subsequently to a first cylinder of said second series of cylinders.

16. A method for adding an unrestrained drying capability to a series of rotating drying cylinders including first and second series of drying cylinders which transport a paper web therethrough, comprising the steps of:

diverting said paper web from said first series of cylinders to a high-intensity air glide drying device for circulating hot gas at said paper web in a temperature range of approximately 400° to 1,000° F., and at a velocity of approximately 10,000 to 20,000 feet per minute, for drying said paper web at an evaporation rate of approximately 15 to 30 pounds per hour per square foot (lbm/hr/ft$^2$) of said paper web, to improve cross-directional stretch and tensile energy absorption therein; and subsequently providing said paper web to said second series of drying cylinders for transport therethrough.

17. The method of claim 16, wherein:

said hot gases are in a temperature range of approximately 500°–850° F.

18. The method of claim 16, wherein:

during said circulating of said hot gases, a sheet moisture content of said paper web decreases by at least approximately 5%.

19. The method of claim 16, wherein:

said paper web comprises uncoated sack kraft grade paper.

20. The method of claim 16, wherein:

a sheet moisture content of said paper web decreases from approximately 40–75% to approximately 10–20%.

* * * * *